United States Patent [19]

Bowler et al.

[11] 4,403,361

[45] Sep. 13, 1983

[54] TECHNIQUES FOR STRIPPING A SLEEVE FROM RESIN IMPREGNATED FIBROUS ROVINGS

[75] Inventors: Raymond M. Bowler, Salem, N.H.; Jules N. Allard, Tyngsboro, Mass.

[73] Assignee: Bush Universal, Inc., Woburn, Mass.

[21] Appl. No.: 236,570

[22] Filed: Feb. 20, 1981

[51] Int. Cl.[3] ..... A63D 9/00

[52] U.S. Cl. ..... 12/142 R; 12/146 S; 12/1 R

[58] Field of Search ..... 12/1 R, 1 W, 1 A, 142 R, 12/146 R, 146 S

[56] References Cited

U.S. PATENT DOCUMENTS

| | | | |
|---|---|---|---|
| 3,439,367 | 4/1969 | Becka et al. | 12/1 R |
| 4,081,917 | 4/1978 | Bradley et al. | 12/146 S |
| 4,122,573 | 10/1978 | Stanton | 12/146 S |

*Primary Examiner*—Patrick D. Lawson

*Attorney, Agent, or Firm*—Wolf, Greenfield & Sacks

[57] ABSTRACT

A method and apparatus for stripping a sleeve from a length of resin-impregnated fiberglass rovings and for cutting a length of the impregnated fibers. The invention severs and separates the sleeve in a manner which assures that the fibers will remain compact and in which substantially all of the resin remains with the fiber rovings. The material is advanced through the stripper solely by drawing on the severed sleeve and without gripping or otherwise disrupting the fibers.

10 Claims, 8 Drawing Figures

Fig. 1
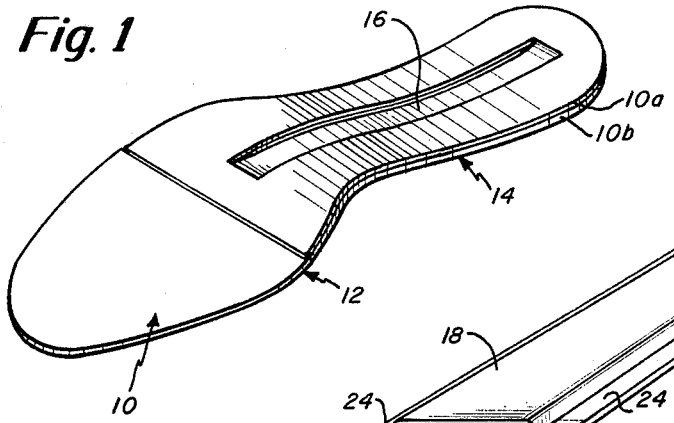
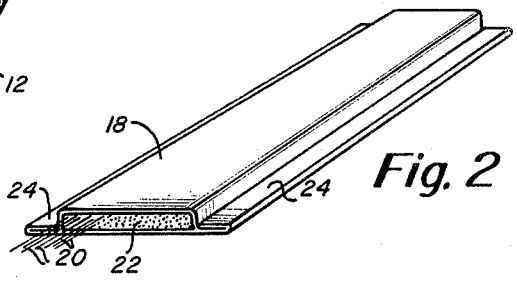
Fig. 2
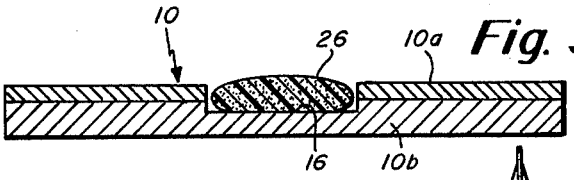
Fig. 3
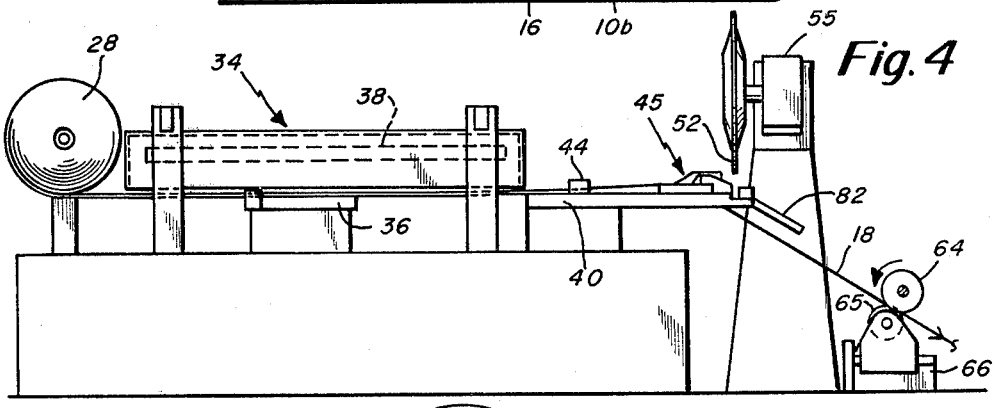
Fig. 4
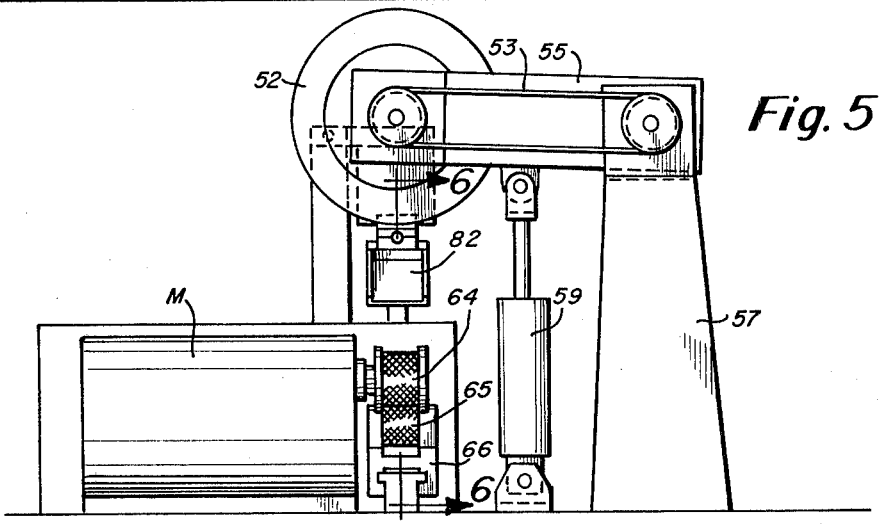
Fig. 5

TECHNIQUES FOR STRIPPING A SLEEVE FROM RESIN IMPREGNATED FIBROUS ROVINGS

BACKGROUND OF THE INVENTION

This invention relates to resin-impreganated fibrous stiffening materials, for example, the type described and disclosed in U.S. Pat. Nos. 4,081,917, issued Apr. 4, 1978 and 4,162,583, issued July 31, 1979. Those patents, assigned to the assignee of this invention, describe articles, techniques and devices for use in initially flexible and deformable shank stiffener elements which, once applied to the bottom of an insole, then can be activated and cured to a hardened, stiff shank element. The material normally is available in reeled-up lengths of fiberglass impregnated with an activatable resin material, all encased within an impermeable sleeve. While in many shoemaking applications, the material may be used without stripping the sleeve, there are some instances in which it may be desired to use the impregnated fiberglass rope without the sleeve. This invention relates to an improved method and apparatus for stripping the sleeve and severing a length of the impregnated fibers. For example, the strip and severed material may be used in practicing an invention as described in an application filed of even date herewith by Jules N. Allard and entitled "Techniques for Stiffening Shoe Insoles".

SUMMARY OF THE INVENTION

The invention employs shank strip material which is initially flexible and conformable to the contour of the bottom of a curved shoe insole or the like. The material is available in rope-like form and includes reinforcing fibers impregnated with a thermosetting resin, all encased within an elongate sleeve. In the present invention, the material preferably is stripped of its sleeve by a device which strips, cuts and delivers a predetermined length of the resin-impregnated material.

In general, the stripping and cutting device preheats the material before drawing it through special stripping and severing devices. The stripping device includes a separator tube to receive the fibers, while the sleeve passes over the periphery of the separator tube. The separator tube also assures that the fibers will remain compacted and will not separate. The separator tube also assures that substantially all of the resin will be wiped oif of the sleeve and will remain with the rope. The separator tube guides the impregnated fibers to a cutting station where a cutting wheel severs the predetermined length of material. The sleeve, which is spread by the ring-like inlet end of the separator tube is guided about the outside of the tube to a stationary slitting knife which continuously slits the advancing sleeve. The slit sleeve then is drawn away from the separator tube toward a drawing station where it is gripped and pulled by draw rolls which, in turn, are intermittently driven by a motor to advance a predetermined length of material. The motor-driven draw rolls constitute the entire advancing means for both the sleeve and the impregnated fibers. p It is among the objects of the invention to provide a method and apparatus for stripping the sleeve from an encased, elongate length of resin-impregnated fiber rovings.

Another object of the invention is to provide a stripping device of the type described which maintains the fibers in compact configuration and which assures that the substantial portion of the impregnating resin is wiped from the interior of the sleeve and remains impregnated among the fibers.

Another object of the invention is to provide a stripping device of the type described which presents a minimal resistance to advancement of the material through this slitting and separating system and which enables the fiber material to be advanced through the system without imparting any direct grip on the fibers.

Still another object of the invention is to provide a stripping and severing device having feeding means for delivering, on demand, a precisely controlled length of stripped, impregnated fibrous material.

DESCRIPTION OF THE DRAWINGS

The foregoing and other objects and advantages of the invention will be appreciated more fully from the following further description thereof, with reference to the accompanying drawings wherein:

FIG. 1 is an illustration of an insole, bottom up, which has been grooved to receive a shank;

FIG. 2 is an illustration of shank strip material before it is stripped;

FIG. 3 is a transverse sectional view of an insole of the type shown in FIG. 1 having a length of shank strip material on the bottom;

FIG. 4 is a side elevation of the stripping and cutting device;

FIG. 5 is an end view of the stripping and cutting device as seen from the right of FIG. 4;

DESCRIPTION OF THE PREFERRED EMBODIMENT

Figures 6, 7, 8:
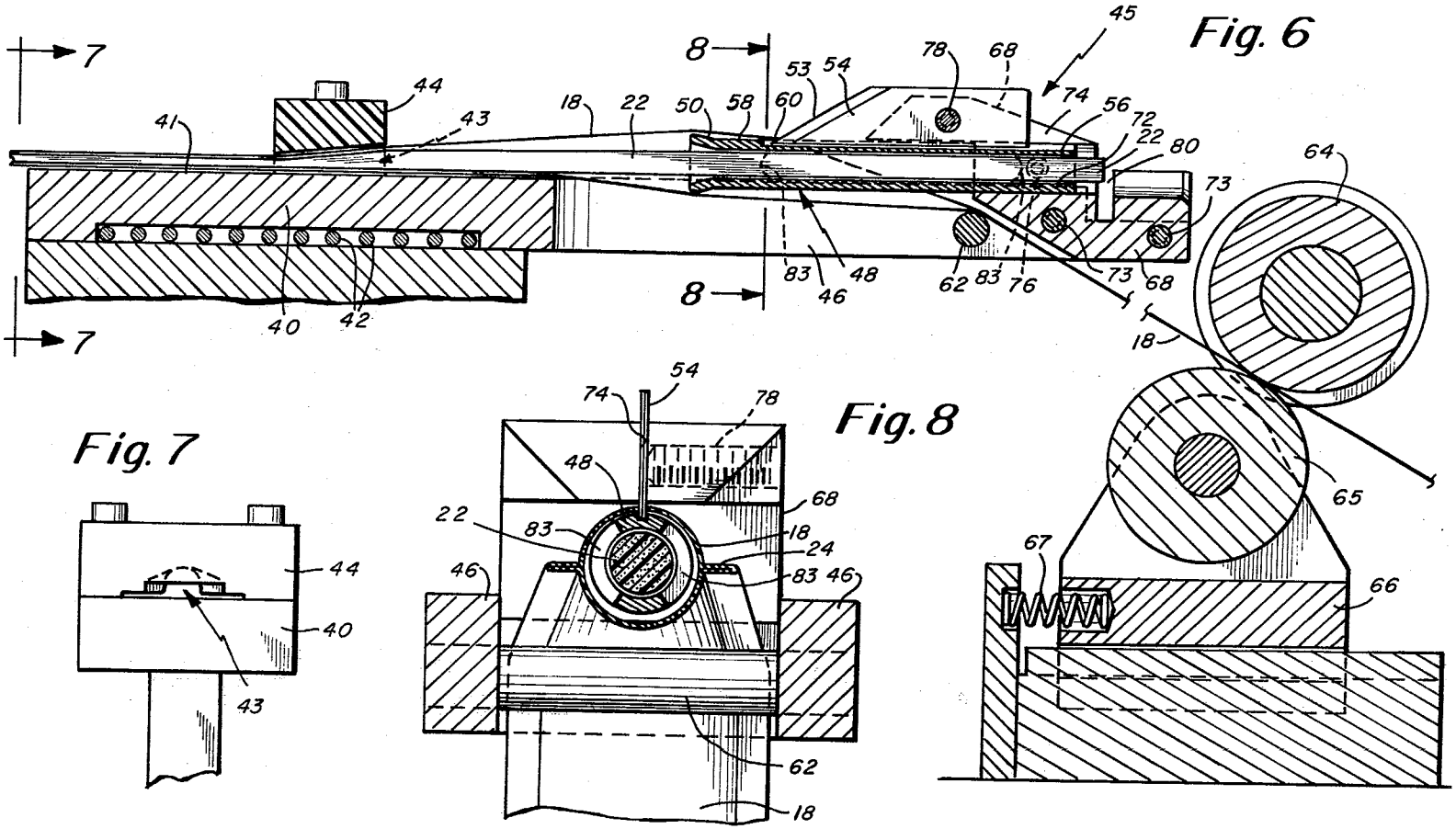
FIG. 6 is an enlarged sectional illustration of the stripping and slitting device as seen along the line 6—6 of FIG. 5.
FIG. 7 is an elevation as seen along the line 7—7 of FIG. 6.
FIG. 8 is an enlarged sectional illustration as seen along the line 8—8 of FIG. 6.

FIG. 1 illustrates an insole 10 (bottom-up) which typically will have a curve at its ball region 12 and a curved shank region which defines an arch 14. The material with which the present invenion is concerned may be used as a shank stiffener for such insoles. The bottom of the insole 10 may be formed with a groove 16 to receive the shank stiffener material. The groove 16 may extend from the heel seat region to approximately the ball region, the precise length of the groove being somewhat a function of the intended length of the shank. With the present invention, the length of the shank may be controlled as the manufacturer desires and can be adjusted easily.

FIG. 2 illustrates a commercially available form of the material useable in accordance with the present invention. The material is available in rope form and includes a sleeve 18 which contains elongate fiberglass reinforcing fibers 20 and a matrix of thermosetting resin 22, activatable by heat or other external stimulus. The sleeve 18 may have margins 24 which facilitate gripping and manipulation of the sleeve 18 in other systems, such as, for example, that disclosed in U.S. Pat. No. 4,161,048, issued July 17, 1979.

In accordance with the illustrative embodiment of this invention, the sleeve 18 is stripped from the resin impregnated fiberglass and a strip of the impregnated material is severed. The material is easily conformable to various contour and curved surfaces, such as the bottom of a shoe insole.

The material, as illustrated in FIG. 2, typically will be reel wound from which it may be drawn as needed. FIG. 4 illustrates, somewhat diagrammatically, the device by which the outer sleeve 18 is stripped away from the impregnated fibers. The reel 28 of material is mounted for rotation to enable the material to be drawn off as needed. The material is guided past a preheating station 34. The preheating station 34 may include a platform 36 over which the material is passed and an overhead radiant heater 38. The heater 38 is operated to raise the temperature of the material and particularly the resin 22 to lower its viscosity so that it may be handled more easily in the subsequent spreading, slitting and separation of the sleeve.

From the preheat station 34, the material passes along the upper surface of an elongate heated block 40. The block 40 is heated by a heater element 42 (FIG. 6) to maintain the lowered viscosity of the resin. As the shank material advances along the upper surface 41 of the block 40, it passes through a shaping element 44 which cooperates with the upper surface 41 of block 40 to define a shaping passage 43 for the material. The shaping passage 43 (FIG. 7) draws the relatively flat ribbon of reinforcing fibers to a more rounded, circular cross section. This maintains the compactness of the fibers. To this end, the underside of the shaping element 44 is provided with a contoured surface sufficient to effect the desired shape into a cylindrical cross section.

After the material exits from the shaping element 44 it passes to the slitting and stripping station indicated generally at 45 in FIG. 4. The slitting and stripping station 45 is mounted to a pair of spaced fingers 46 which are formed integrally with and extend rearwardly from the block 40. As illustrated in more detail in FIGS. 6–8, the slitting and stripping mechanism 45 includes a separator tube 48. The receiving end of the separator tube 48 may be somewhat bell-mounted, as indicated at 50, to define a ring-like spreader for the sleeve 18 of the material. The spreader ring 50 receives the fiberglass which has been preshaped and pre-compacted to a generally circular cross section by the shaping element 44. The spreader ring 50 is received within the sleeve 18 which continually advances over and is spread by the spreader ring 50. The resin-impregnated rope continus to advance through the separator tube 48 and to the cutting station where a cutting wheel 52 (FIG. 4) can sever a length of the withdrawn impregnated fiberglass.

The separator tube also serves to maintain the fibers in a compacted configuration. The compacting effect, however, is not so great as to impart any significant drag which might adversely affect the feeding of the rope and sleeve. In addition, the periphery of the spreader ring 50 tends to wipe the inner surface of the sleeve of excess resin to assure that substantially all of the resin will remain with the fibers.

The sleeve which passes over the spreader ring 50 advances to and is slit by the cutting edge 53 of a fixed knife blade 54. The knife blade 54 lies within a longitudinally extending slot 56 formed along the top surface 58 of the separator tube 48. The point 60 of the knife 54 should be sharp and located slightly below the top surface 58 of the tube 48.

The slit sleeve 18 then is drawn downwardly and along both sides of the tube 48 to a transverse guide pin 62 which extends across the slot defined by the fingers 46. The guide pin 62 directs the sleeve downwardly and outwardly out of the way. The slit sleeve 18 is drawn by a pair of gripping rolls 64, 65, one of which is driven by suitable motor M. The other gripping roll 65 may be mounted to a slide 66 biased by a spring 67 toward the drive roll 64.

The separator tube 48 and knife 54 are supported by a mounting bracket 68 secured to the fingers by bolts 73. A bore 72 and slot 74 formed in the bracket 68 receive the forward end of the separator tube 48 and the knife 54, respectively. The outlet end of the separator tube 48 is clamped in the bracket by another bolt 76 and the knife is further secured by a set screw 78 which drives the slot 74 of the bracket.

The bracket 68 also includes a slot 80 to receive the cutting wheel 52 FIG. 4) when the wheel 52 is advanced downwardly to sever a length of the stripped shank material. A trough 82 (FIG. 4) may be attached to and extend forwardly from the end of the arms 46 to hold the severed material until the operator desires to use it. The wheel 52 is driven by a belt 53, both being supported on an arm 55. The arm 55 is pivoted on a post 57 and is moved up and down in a cutting stroke by cylinder 59.

From the foregoing, it will be appreciated that the material is drawn through the device entirely by the rolls 64, 65 which grip and draw the slit sleeve 18. Moreover, the pull of the rolls 64, 65 actually is imparted to the impregnated fibers at a location upstream of and in advance of the stripping station. The rope material and resin thus is actually pushed through the tube 48. It is unnecesary to grip or otherwise impart any feeding force to the fiberglass This tends to insure that neithe the fibers nor the sleeve will bunch up. It minimizes any tendency for the fiberglass strands to become snaked within the sleeve 18, which might disrupt the smooth operation of the system. In addition, it should be noted that the sides of the separator tube 48 are cut away as indicated at 83 in FIGS. 6 and 8 so as to minimize the surface area to which the resin impregnated fiberglass will be exposed. This further reduces the drag and makes it easier to advance the material through the stripping system.

The length of stripped impregnated matrial which is delivered by the device may be varied by controlling the duration of each intermittent operating cycle of the motor M. Suitable conventional controls (not shown) are employed to begin a delivery cycle by starting the motor M. The motor may be started simply by operation of a convenient switch, such as a whisker switch indicated diagrammatically at 81, located in proximity to the delivery end of the trough 82. The motor may be preset to operate only for a precisely controlled time interval which will determine the length of material which is stripped, severed and delivered. Similarly, suitable controls (not shown) may be utilized to vary the duration of each intermittent cycle of the motor, thereby to provide a means to variably control the length of the shank strip.

In addition, it should be noted that the material from which the sleeve 18 is made should be sufficiently strong to have relatively little yield under the influence of the drawing rolls 64, 65. The sleeve materials, such as Mylar, as described in the aforementioned prior patents, have been found to be satisfactory.

When the length of impregnated fiberglass has been severed, it will be tacky from the resin and will tend to remain on the trough 82, where it may be picked up when required.

It should be understood that the foregoing description of the invention is intended merely to be illustrative thereof and that other modifications nd embodiments may be apparent to those skilled in the art with departing from its spirit.

Having thus described the invention, what I desire to claim and secure by Letters Patent is:

1. A method for stripping an encasing sleeve from resin-impregnated fiber rovings comprising:

preheating the material to decrease the viscosity of the resin;

passing the sleeve over a separator tube while passing the fiber rovings through the separator tube, the separator tube having a generally circular, ring-like inlet whereby the rovings are confined into a generally circular, cross-sectional configuration and the sleeve is spread to a generally circular cross-sectional configuration;

slitting the sleeve at a location downstream of the inlet to the separator tube and then separating the sleeve from the roving by drawing the sleeve in a different direction than that of the roving;

said drawing of said slit sleeve comprising the sole means for advancing the material.

2. A method as defined in claim 1 wherein said step of passing the sleeve over the separator tube further comprises effecting a wiping on the inner surface of the sleeve.

3. A method as defined in claim 1 further comprising maintaining the fibers in compact configuration during said advancing and stripping.

4. A method as defined in claim 1 further comprising preliminarily passing the encased material through a preforming die to initiate transition of the cross-section from a substantially flat ribbon-like configuration to a partly circular configuration.

5. A method as defined in claim 1 where the force for advancing the fiber rovings is applied to the rovings only upstream of the inlet to the separator tube.

6. An apparatus for stripping an encasing sleeve from a resin-impregnated fiber roving comprising:

means for drawing and guiding the encased material along a predetermined path;

preheating means disposed along the path for heating the material to control its viscosity;

a separator tube located along said pad, the separator tube being adapted to be received within the sleeve, and being further adapted to receive fibrous roving through the interior of the sleeve;

the separator tube having an inlet end which is generally circular in cross section thereby to spread the interior of the sleeve to a generally circular configuration while conforming and guiding the impregnated roving through the separator;

a slitting knife located on the exterior of the separator tube to slit the sleeve as the sleeve progressively advances over the separator tube;

sleeve drawing means being located out of alignment with the continuation of the path of advancement of the material, thereby to direct the slit sleeve away from the impregnated roving and along a separate path;

the outlet end of the separator tube being arranged to direct the impregnted roving to a cutting station where a predetermined length of strip material may be severed.

7. An apparatus as defined in claim 6 further comprising:

the inlet end of the separator tube defining a ring-like member, the ring member being flared.

8. An apparatus as defined in claim 6 further comprising:

the sides of the separator tube, being appertured to memorize drag of resin through the separator tube.

9. An apparatus as defined in claim 6 wherein the sleeve drawing means comprises a pair of draw rolls located to grip the slit sleeve;

motor means connected to the draw rolls to drive the draw rolls; and means for controlling the motor to operate the motor for a predetermined time interval sufficient to draw a predetermined length of material through the draw rolls, thereby to control the length of the strip material delivered.

10. An apparatus as defined in claim 6 further comprising preliminary die means to initiate transition of the cross section of the strip from a substantially flat ribbon-like configuration to a generally circular configuration and to maintain the fibers in compacted configurations.

* * * * *